US010648219B2

(12) United States Patent
Babych et al.

(10) Patent No.: US 10,648,219 B2
(45) Date of Patent: May 12, 2020

(54) WINDOW, SHUTTER OR DOOR WITH ADJUSTABLE MOUNTING FRAME

(71) Applicant: Uniline Australia Limited, Brisbane, Queensland (AU)

(72) Inventors: Oleksander Babych, Brisbane (AU); Marc Gomes-Luis, Brisbane (AU); Allan Neale Box, Brisbane (AU)

(73) Assignee: Uniline Australia Limited, Brisbane, Queensland (AU)

( * ) Notice: Subject to any disclaimer, the term of this patent is extended or adjusted under 35 U.S.C. 154(b) by 67 days.

(21) Appl. No.: 16/090,919

(22) PCT Filed: Aug. 25, 2016

(86) PCT No.: PCT/AU2016/050785

§ 371 (c)(1),
(2) Date: Oct. 3, 2018

(87) PCT Pub. No.: WO2017/031543

PCT Pub. Date: Mar. 2, 2017

(65) Prior Publication Data

US 2019/0106928 A1 Apr. 11, 2019

(30) Foreign Application Priority Data

Aug. 25, 2015 (AU) ..... 2015903432

(51) Int. Cl.

| | |
|---|---|
| ***E06B 1/04*** | (2006.01) |
| ***E06B 1/08*** | (2006.01) |
| ***E06B 1/60*** | (2006.01) |

(52) U.S. Cl.
CPC ..... *E06B 1/08* (2013.01); *E06B 1/603* (2013.01)

(58) Field of Classification Search
None
See application file for complete search history.

(56) References Cited

U.S. PATENT DOCUMENTS

| | | | | | |
|---|---|---|---|---|---|
| 451,596 | A | * | 5/1891 | Longenecker | E06B 3/667 52/656.9 |
| 2,711,564 | A | * | 6/1955 | Jackson | E06B 1/08 49/380 |
| 2,854,843 | A | * | 10/1958 | Lamb | E04F 21/04 33/194 |
| 4,228,630 | A | * | 10/1980 | Englert | E06B 3/988 52/204.1 |

(Continued)

FOREIGN PATENT DOCUMENTS

| | | | |
|---|---|---|---|
| EP | 1722063 | A2 | 11/2003 |
| GB | 2214550 | A | 9/1989 |
| GB | 2310239 | A | 8/1997 |

*Primary Examiner* — Basil S Katcheves
(74) *Attorney, Agent, or Firm* — Gable Gotwals

(57) ABSTRACT

A window, shutter or door assembly including a window, shutter or door including a rigid surround frame with a number of peripheral sides and an adjustable mounting frame including at least one frame member relative to each peripheral side of the rigid surround frame of the window, shutter or door and movable relative thereto to abut part of a periphery of an opening into which the window, shutter or door assembly is to be fitted to adjust the size of the adjustable mounting frame in one or more dimensions to fit the opening.

21 Claims, 8 Drawing Sheets

(56) References Cited

U.S. PATENT DOCUMENTS

| | | | | | |
|---|---|---|---|---|---|
| 4,430,831 | A * | 2/1984 | Kemp | E06B 1/32 | 249/39 |
| 5,319,884 | A * | 6/1994 | Bergeron | E06B 5/08 | 49/466 |
| 5,445,244 | A * | 8/1995 | Ketonen | B66B 13/306 | 187/325 |
| 5,711,120 | A * | 1/1998 | Karpen | E06B 5/165 | 52/204.54 |
| 5,921,056 | A * | 7/1999 | Weiss | E06B 1/62 | 52/212 |
| 5,927,039 | A * | 7/1999 | De Boer | E06B 1/62 | 403/402 |
| 6,070,375 | A * | 6/2000 | Anderson | E04G 15/02 | 52/204.54 |
| 7,223,044 | B2 * | 5/2007 | Quintile | E06B 3/9885 | 248/300 |
| 7,587,868 | B2 * | 9/2009 | Hughes | E04G 15/02 | 52/205 |
| 8,006,445 | B2 * | 8/2011 | Burton | E06B 1/58 | 49/475.1 |
| 8,069,622 | B2 * | 12/2011 | Mees | E06B 3/988 | 52/213 |
| 8,458,969 | B2 * | 6/2013 | Richardson | E06B 1/02 | 249/13 |
| 2009/0025320 | A1 * | 1/2009 | Wagner | E06B 1/52 | 52/217 |
| 2010/0212239 | A1 * | 8/2010 | Wang | E06B 1/20 | 52/217 |

* cited by examiner

WINDOW, SHUTTER OR DOOR WITH ADJUSTABLE MOUNTING FRAME

CROSS-REFERENCE TO RELATED APPLICATIONS

This United States application is the National Phase of PCT Application No. PCT/AU2016/050785 filed 25 Aug. 2016, which claims priority to Australian Patent Application No. 2015903432 filed 25 Aug. 2015, each of which is incorporated herein by reference.

TECHNICAL FIELD

The present invention relates to a window, shutter or door with adjustable mounting frame and an adjustable mounting frame for mounting a window or shutter.

BACKGROUND ART

Building constructions often include windows, doors or shutter assemblies in order to provide light and ventilation into the building or between different portions of the buildings. When installed, windows, doors or shutters are normally installed within an opening which is preformed into a wall. Clearly, the dimensions of the preformed opening cannot be adjusted without great difficulty and expense and normally, the opening is measured carefully in order to ensure that the windows, doors or shutters are made as close as possible to the size of the opening.

However, errors frequently occur in the measurement of the external dimension of the window, door or shutter and the preformed window, door or shutter arrives on site and does not fit into the opening in the wall. This can be a particular problem if the window, door or shutter is too large and in that instance, normally, the window, door or shutter is returned to the manufacturer.

In cases where the window, door or shutter is too small however, the installer has a number of different options, most of which normally involve providing packing material, usually smaller pieces of wood or similar, between the external frame of the window, door or shutter and the periphery of the opening.

Installers also use packing to ensure that the window, door or shutter is level and square within the opening which may not itself be square. Any packing and the periphery of the window, shutter or door can then be covered by one or more surrounds in order that the window looks to be the correct size in the opening when in actual fact it may not be.

The use of packing can be problematic as it creates pressure points for the window and the windows itself can sag again out of shape even though the packing is provided. Normally this happens over time and not immediately, but the problems can be faced later on.

It will be clearly understood that, if a prior art publication is referred to herein, this reference does not constitute an admission that the publication forms part of the common general knowledge in the art in Australia or in any other country.

SUMMARY OF INVENTION

The present invention is directed to a window, shutter or door with adjustable mounting frame, which may at least partially overcome at least one of the abovementioned disadvantages or provide the consumer with a useful or commercial choice.

With the foregoing in view, the present invention in one form, resides broadly in a adjustable mounting frame for mounting a window, shutter or door into an opening, the window, shutter or door including a rigid surround frame with a number of peripheral sides and one or more infill portions, the adjustable mounting frame including at least one frame member relative to each peripheral side of the rigid surround frame of the window, shutter or door and movable relative thereto to abut part of a periphery of the opening to adjust the size of the adjustable mounting frame in one or more dimensions.

In another aspect, the present invention resides in a window, shutter or door assembly including a) a window, shutter or door including a rigid surround frame with a number of peripheral sides and one or more infill portions and b) an adjustable mounting frame including at least one frame member relative to each peripheral side of the rigid surround frame of the window, shutter or door and movable relative thereto to abut part of a periphery of an opening into which the window, shutter or door assembly is to be fitted to adjust the size of the adjustable mounting frame in one or more dimensions to fit the opening.

The provision of the adjustable mounting frame of the present invention allows a window, door or shutter or other building construction configuration to be mounted into an opening which is larger than the external dimension of the window, door, shutter or other building construction or which is oddly sized or out of square for example.

The adjustable mounting frame members are movable, preferably independently of one another in order to take up any inconsistency within the opening and to position and mount the window, door or shutter or other building construction, in the opening. The present invention is particularly adapted for use in mounting a window, shutter or door but could be used to mount doors or other building panels or structures such as a screen or the like.

The present invention may be used in external or internal mounting locations. Further, the window, shutter or door may be of any type including a fixed window, a blind, a louvre or a sliding window in addition to more common types of windows such as a casement window or double hung window.

In some forms, the present invention includes a window, shutter or door having a rigid surround frame with a number of peripheral sides and an infill portions. As mentioned above, the infill portions can be of any type. Any number of infill portions can be provided. According to a preferred embodiment, the infill panel is or includes a movable panel or window which has its own external surround frame located within the rigid surround frame of the window or shutter. There can therefore be more than one rigid surround frame provided in a window, shutter or door namely an inner surround frame which surrounds louvres or shutter members for example and an outer rigid surround frame relative to which the adjustable mounting frame is provided.

The rigid surround frame of the window, shutter or door is preferably fixed in size and shape. Normally, the rigid surround frame is rectangular although it may be any shape. In most window, shutter or door configurations, the rigid surround frame will have four sides, each of which is substantially planar to define a rectangular window or shutter. Although conventions vary, as the upper member in the rigid surround frame is usually called the "head" member, the lower member is normally called the "sill" member and the left and right side members are generally called "jambs".

As mentioned above, there may be more than one infill portions or an infill portion may be provided within the rigid surround frame which is made up of a number of window, shutter or door assemblies. In other words, one rigid surround frame may be provided with multiple infill panels or a plurality of window, shutter or door assemblies can be provided within a single opening. The multiple infill panels or plurality of window, shutter or door assemblies can be provided in any configuration. For example, a number of infill panels or window, shutter or door assemblies can be provided vertically relative to one another or horizontally to one another or both. One or more fixed separator members or assemblies can be provided between infill panels or window, shutter or door assemblies in a single opening.

It is important that the configuration inside the adjustable mounting frame is less important than the adjustable mounting frame itself and its relationship with the rigid surround frame and the mechanism of movement of the adjustable mounting frame relative thereto.

The adjustable mounting frame of the present invention can be provided in a full reveal, semi reveal or face fit configuration.

The present invention includes an adjustable mounting frame including at least one adjustable mounting frame member provided relative to each peripheral side of the rigid surround frame of the window, shutter or door and which is movable relative thereto. Depending upon the size of the window or shutter, more than one adjustable mounting frame member may be provided relative to each peripheral side. Typically, for smaller windows or shutters, a single elongate adjustable mounting frame member per side will be provided but more than one adjustable mounting frame member per side may be provided for larger window assemblies. Each of the adjustable mounting frame members will typically be elongate.

It is preferred that each of the adjustable mounting frame members be at least partially U-shaped. In this preferred form, each of the adjustable mounting frame members will preferably be provided with a pair of spaced apart walls between which the respective frame member of the rigid surround frame of the window, shutter or door is received. In use, when the adjustable mounting frame member is moved away from the rigid surround frame of the window, shutter or door in order to fit the opening, the spaced apart walls will preferably hide any adjustment mechanism as well as to cover any separation gaps between the adjustable mounting frame members and the rigid surround frame members which may be cause due to their separation. The pair of spaced apart walls will preferably have a transverse wall extending therebetween.

According to these preferred configurations, the adjustable mounting frame members will normally be U-shaped but may be H shaped. Preferably, the mechanism for movement of the adjustable mounting frame members will be provided between the spaced apart walls of the adjustable mounting frame members and normally relative to the transverse wall of the adjustable mounting frame members.

The adjustable mounting frame members may be made from any material but normally, the material used will be similar to the rigid surround frame of the window or shutter.

The adjustable mounting frame members of the preferred embodiment will preferably abut the periphery of the opening into which the window, shutter or door is fixed and some expansion of the adjustable mounting frame will normally be required in order to achieve this. One or more fixtures may be used in order to permanently fix the adjustable mounting frame member(s) in place and thereby fix the window, shutter or door in place. These fixtures may be provided into and preferably through the adjustable mounting frame members once the adjustable mounting frame has been fitted in place and expanded.

The permanent fixture of the adjustable mounting frame members relative to the periphery of the opening may require some assembly of the adjustment mechanism and/or the rigid surround frame relative to the adjustable mounting frame members. Preferably, the permanent fixtures may be hidden fixtures and therefore, the permanent fixtures may be provided through the transverse wall of each adjustable mounting frame member once the mounting frame member has been properly fit into the opening.

The adjustable mounting frame members may have square cut ends but will preferably be mitre cut.

The adjustable mounting frame members are movable relative to the rigid surround frame through the provision of one or more adjustment mechanisms. Any type of mechanism can be used and any number of mechanisms may be provided on or relative to each of the adjustable mounting frame members.

According to a particularly preferred embodiment, two adjustment mechanisms are provided on any one adjustable mounting frame member. Each of the preferred adjustment mechanisms are normally provided towards opposite ends of the adjustable mounting frame member which will allow an installer to move the ends of each adjustable mounting frame member independently of one another to adjust the separation distance of the adjustable mounting frame member relative to the rigid surround frame and/or the angle of the adjustable mounting frame member relative thereto. According to this configuration, a rectangular window will preferably have eight adjustment mechanisms, two provided on each side, relative to the adjustable mounting frame member on each side.

The preferred adjustment mechanism is simple and robust. A threaded mechanism is particularly preferred allowing an installer to rotate a threaded member in order to adjust the effective external dimension and/or shape of the adjustable mounting frame through adjustment of each of the adjustable mounting frame members. This means that an installer can adjust the adjustable mounting frame to the size of the opening and also adjust to account for out of square openings.

A particularly preferred mechanism includes a threaded rod and a pair of internally threaded tubular portions. One tubular portion is preferably provided in the rigid surround frame member and a corresponding tubular portion is provided in the adjustable mounting frame member. Typically the tubular portions are coaxial in order for the rod to engage both. The rod will preferably be threaded and normally, over its entire length in order to give the maximum possible adjustability. It is particularly preferred that the opposite ends of the rod have opposite threads or threads extending in different directions, opposite one another. The tubular portions provided will preferably correspond to the threaded portions on the opposite ends of the rod. This configuration means that smaller rotations of the threaded rods will preferably result in larger adjustments of the separation distance between the adjustable mounting frame member and the rigid surround frame meaning that an installer can save time in the adjustment process.

According to the preferred embodiment, the opposite threads on the rod will preferably extend over approximately half of the length of the rod each.

Preferably, a tubular portion is provided in the transverse wall of the adjustable mounting frame member and in the rigid surround frame, the tubular portion is preferably recessed within the thickness of the rigid surround frame member. Typically, the end of the threaded rod will also be recessed below the surface of the rigid surround frame member. The threaded rod will typically be accessible through an opening in a surface of the rigid surround frame member and this opening may be temporarily covered by a cap or cover or similar.

The accessible end of the threaded rod will normally have a shaped opening for receiving a portion of a tool used to rotate the threaded rod. Normally, a screwdriver will be used and therefore the opening can be configured appropriately with either a slot or a Philips head drive. In use, the window, shutter or door assembly will be placed within the opening and the installer will then use the adjustment mechanisms around the window, shutter or door in order to drive the rods in the different adjustment mechanisms to expand the adjustable frame in order to fit the opening. Following the adjustment, the window, shutter or door assembly will normally be fixed permanently within the opening.

According to a preferred embodiment, a cover member or assembly is preferably provided at the corners of the adjustable mounting frame in order to cover the gaps created between the adjustable mounting frame members caused by the expansion of the adjustable mounting frame. In a preferred embodiment, the corner cover members mounted relative to the adjustable mounting frame members. The mounting can be achieved in any way but normally, the cover members will clip onto the adjustable mounting frame members, but allow the adjustable mounting frame members to slide relative thereto.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DESCRIPTION OF EMBODIMENTS

Figure 1:
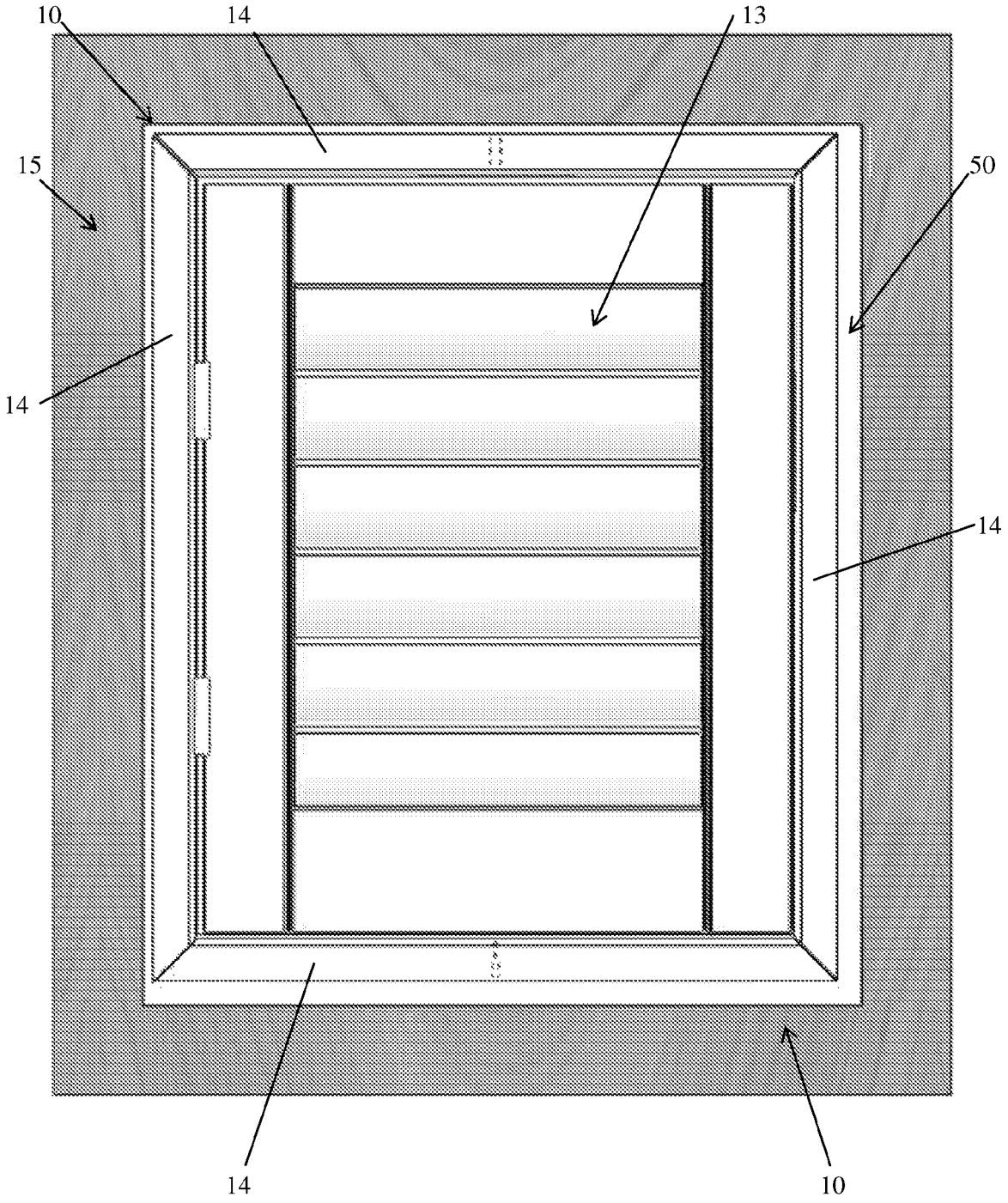
FIG. 1 is a front elevation view of a window, shutter or door assembly according to a preferred embodiment of the present invention in the collapsed condition with the corner covers removed for clarity.

According to a particularly preferred embodiment of the present invention, a window, shutter or door assembly with an adjustable mounting frame is provided.

The window, shutter or door assembly 10 illustrated in FIGS. 1 to 8 includes a window, shutter or door having a rigid surround frame 11 with a number of peripheral surround frame members 12 and an infill portion 13. An adjustable mounting frame is provided including an adjustable mounting frame member 14 relative to each peripheral side of the rigid surround frame 12. Each adjustable mounting frame member 14 is movable relative to the respective member of the rigid surround frame 12 to abut part of a periphery of an opening 50 in a wall 15 into which the window, shutter or door assembly 10 is to be fitted to adjust the size of the adjustable mounting frame in one or more dimensions to fit the opening 50.

The provision of the adjustable mounting frame of the present invention allows a window, door or shutter for example to be mounted into an opening 50 which is larger than the external dimension of the window, door, shutter or other building construction (as illustrated in FIG. 1) or which is oddly sized or out of square for example. This will provide greater flexibility in installation, the ability to have more "standard sized windows" and minimise custom or bespoke window sizes and also to account for slightly out of square openings.

Figure 2:
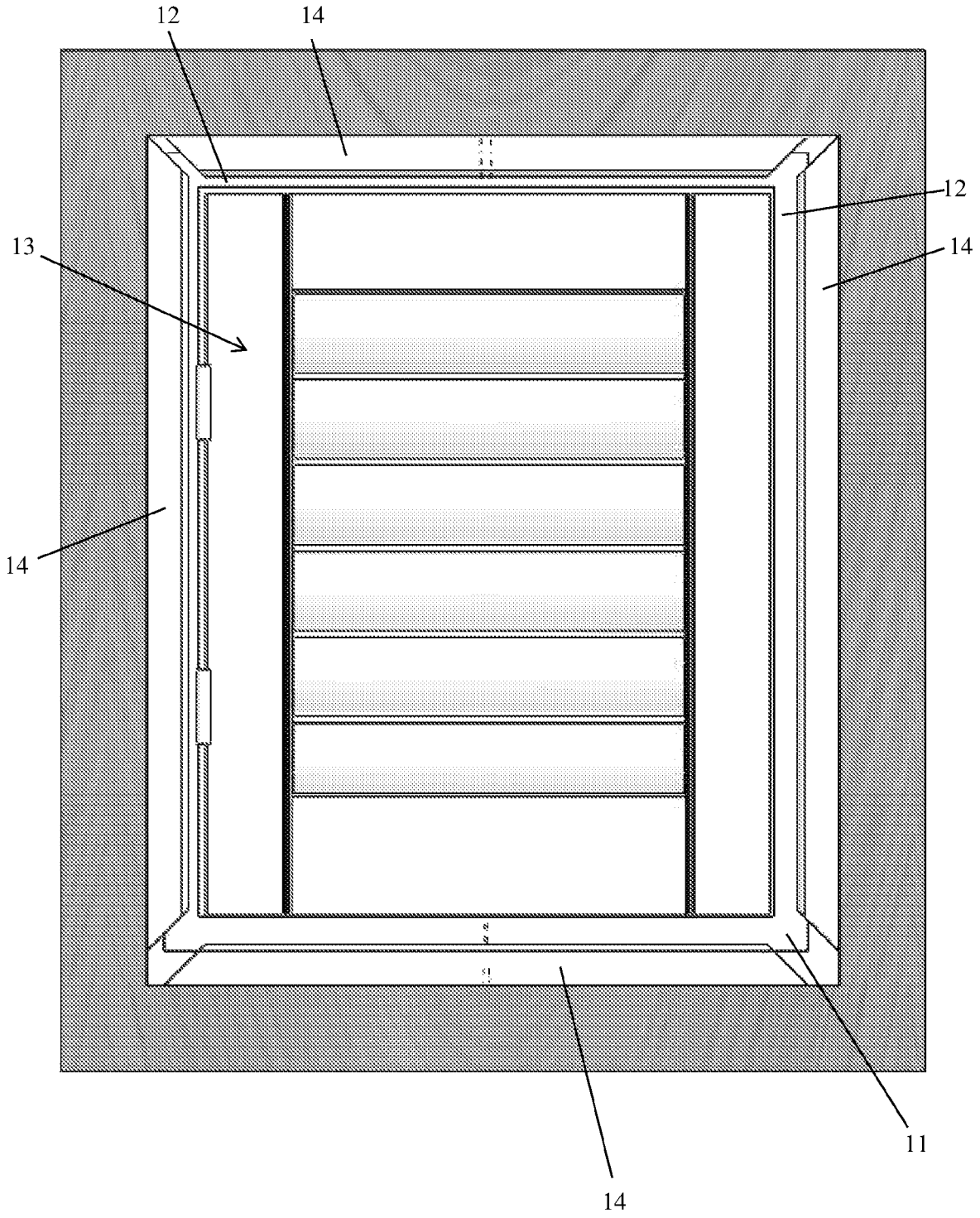
FIG. 2 is a front elevation view of the window, shutter or door assembly illustrated in FIG. 1 in the expanded condition.
Figure 3:
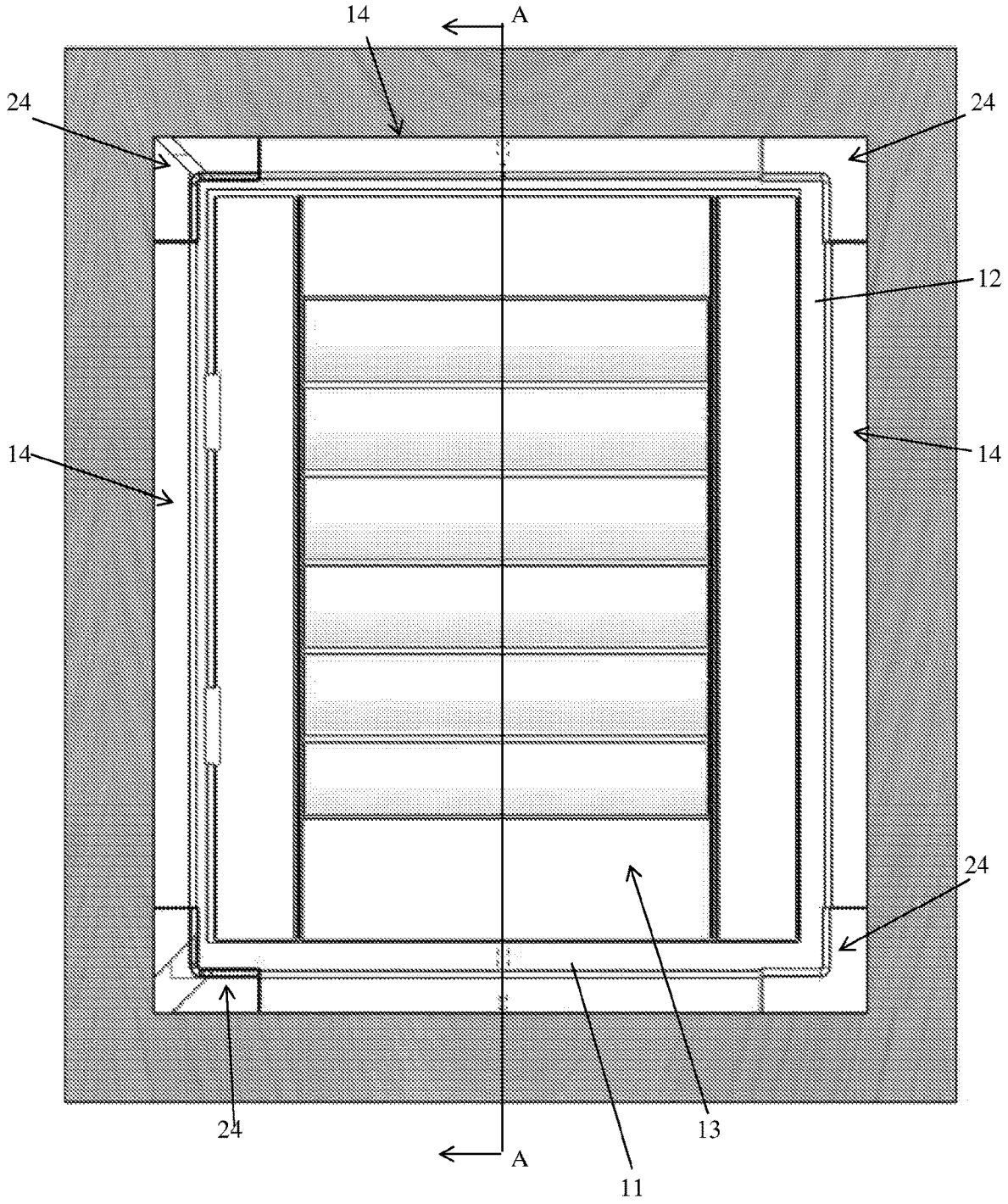
FIG. 3 is a front elevation view of the window, shutter or door assembly of FIG. 2 with the corner covers but the leftmost corner covers being transparent.
Figure 4:
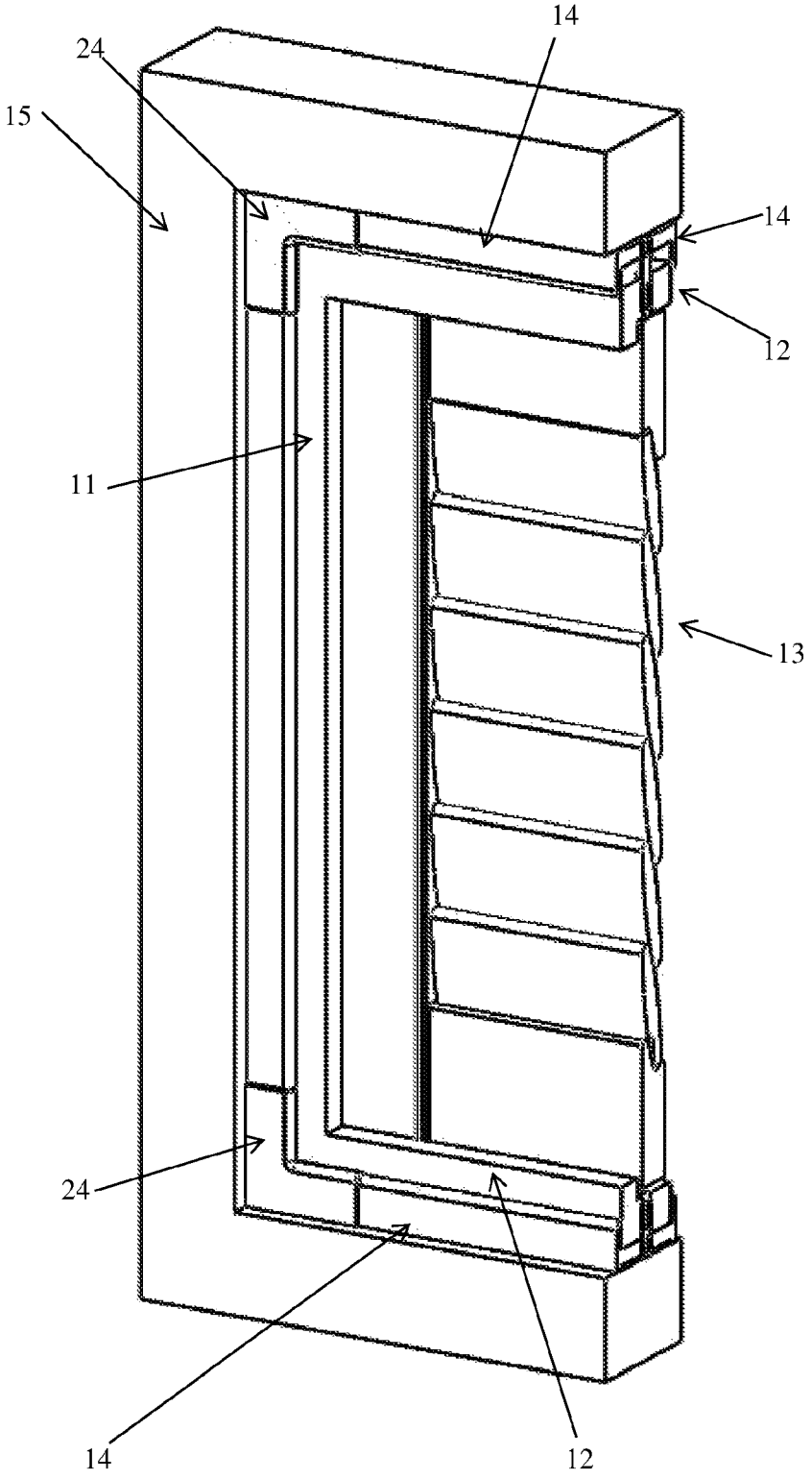
FIG. 4 is a sectional isometric view of the window, shutter or door assembly of FIG. 3 along line A-A.

In FIGS. 1 to 3, the adjustable mounting frame members 14 are movable independently of one another in order to take up any inconsistency within the opening and to position and mount the window, door or shutter 10, in the opening.

The illustrated window, shutter or door assembly 10 has a rigid surround frame with a number of peripheral surround from members 12 and an infill portion 13 configured as a shutter. The shutter infill portion 13 has its own external surround frame located within the rigid surround frame.

The rigid surround frame 11 of the window, shutter or door is fixed in size and shape. In most window, shutter or door configurations, the rigid surround frame has four sides, each of which is substantially planar to define a rectangular window or shutter.

The adjustable mounting frame of the present invention can be provided in a full reveal, semi reveal or face fit configuration. In the embodiment, the shutter assembly is a reveal fit configuration.

Depending upon the size of the window or shutter, more than one adjustable mounting frame member 14 may be provided relative to each peripheral side but, for smaller windows or shutters such as that illustrated in FIGS. 1 to 8, a single elongate adjustable mounting frame member 14 per side is provided. Each of the adjustable mounting frame members 14 is elongate.

Figure 5:
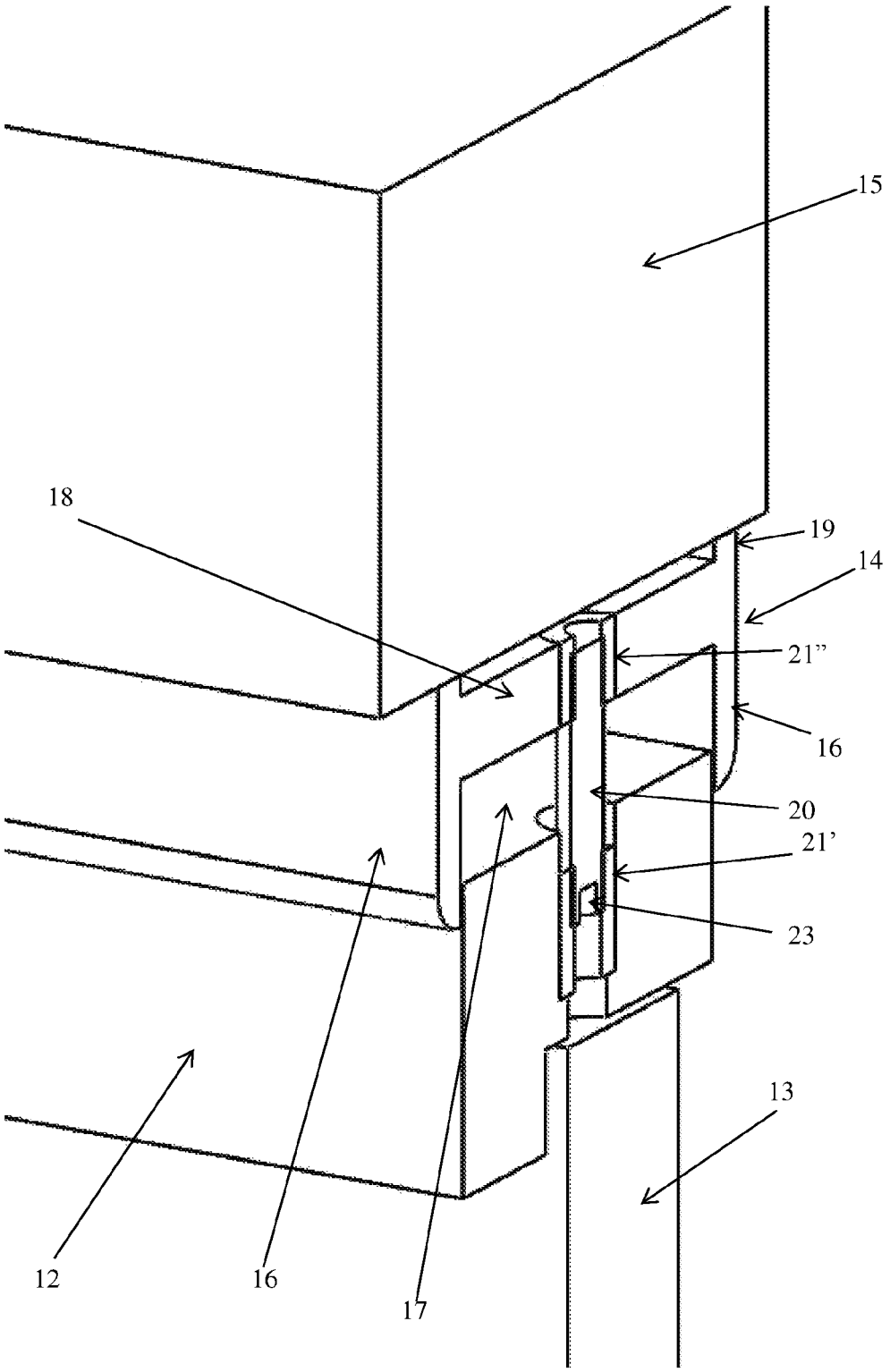
FIG. 5 is a detailed view of the portion identified in FIG. 4 using reference letter "B".

The preferred embodiment of adjustable mounting frame members illustrated is H shaped. In this preferred form as best illustrated in FIG. 5, each of the adjustable mounting frame members 14 has a pair of spaced apart walls 16 between which the respective frame member 12 of the rigid surround frame of the shutter is received. In use, when the adjustable mounting frame member 14 is moved away from the rigid surround frame 11 of the shutter in order to fit the opening, the spaced apart walls 16 will hide the adjustment mechanism as well as to cover any separation gap 17 between the adjustable mounting frame member 14 and the rigid surround frame members 12 which may be cause due to their separation. The pair of spaced apart walls 16 has a transverse wall 18 extending therebetween. Smaller spaced apart walls 19 extend from the transverse wall 18 to abut the periphery of the opening.

As will be explained in more detail below, the mechanism for movement of the adjustable mounting frame member 14 is provided between the spaced apart walls 16 of the adjustable mounting frame member 14 and normally relative to the transverse wall 18 of the adjustable mounting frame members 14.

The adjustable mounting frame members 14 may be made from any material but normally, the material used will be similar to the rigid surround frame of the window or shutter.

The adjustable mounting frame members of the preferred embodiment will preferably abut the periphery of the opening into which the window, shutter or door is fixed and some expansion of the adjustable mounting frame will normally be required in order to achieve this. One or more fixtures may be used in order to permanently fix the adjustable mounting frame member(s) in place and thereby fix the window, shutter or door in place.

Figure 6:
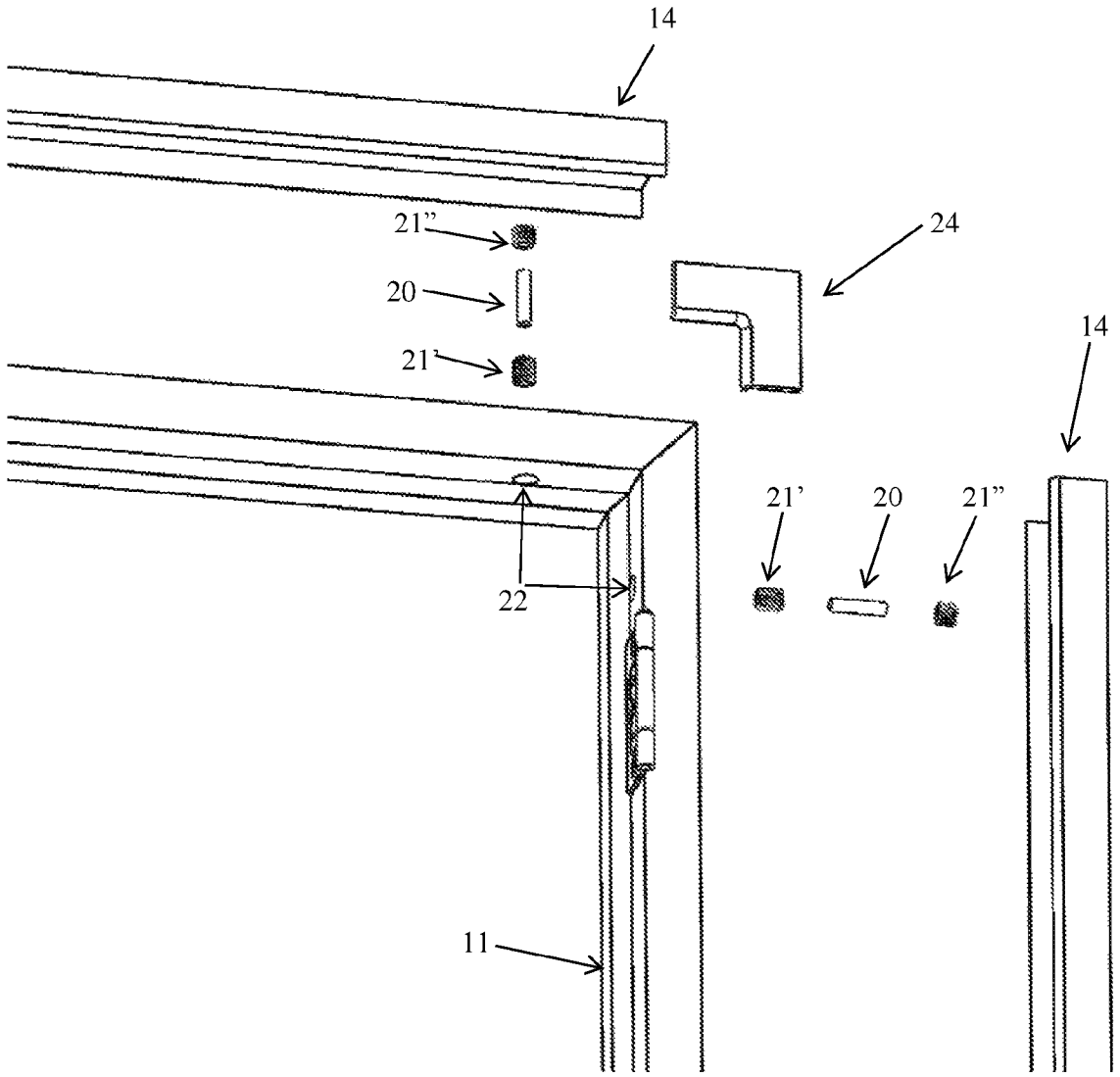
FIG. 6 is an exploded view of one corner of the window, shutter or door assembly illustrated in FIG. 3.
Figure 7:
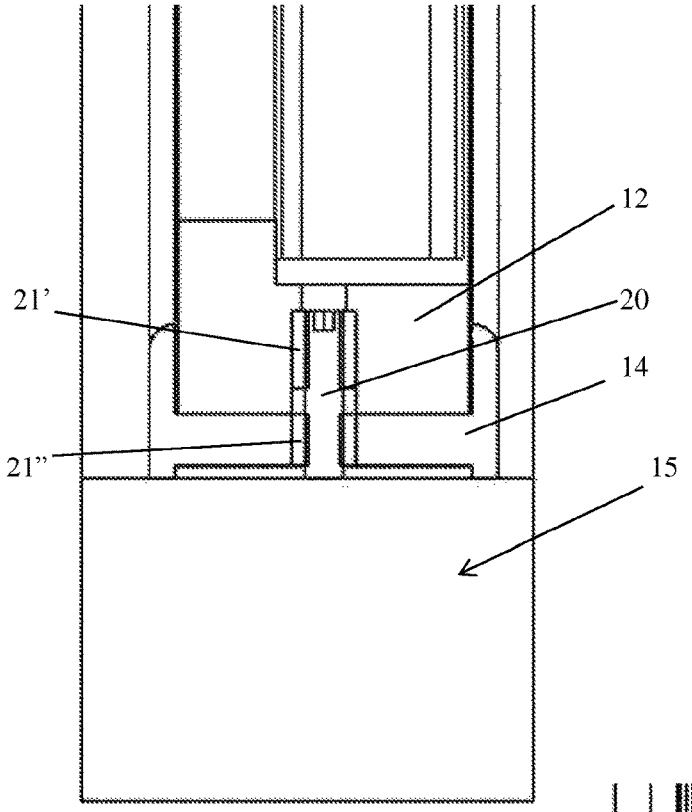
FIG. 7 is a detailed end elevation view of the configuration illustrated in FIG. 5 in the collapsed condition.
Figure 8:
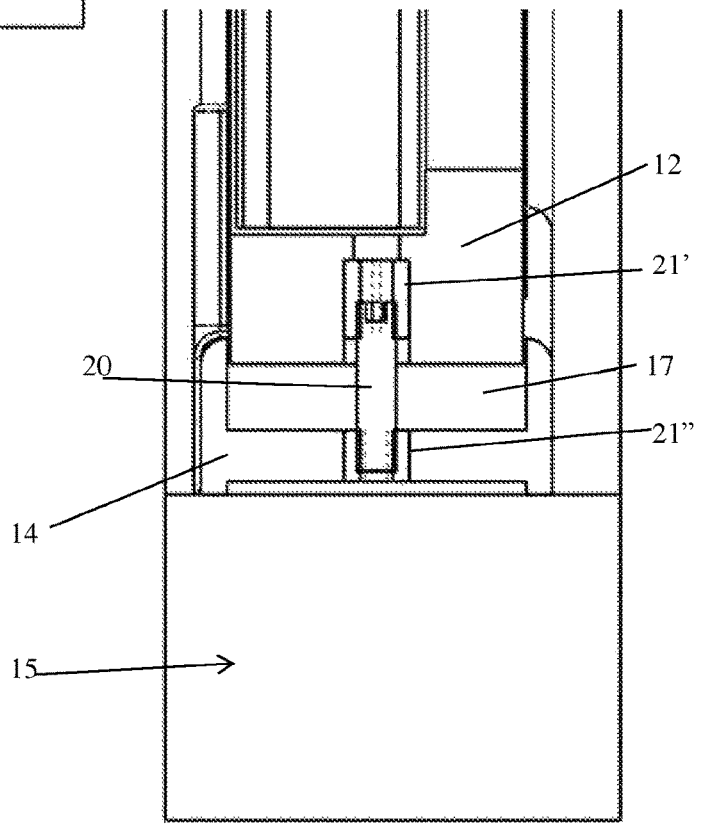
FIG. 8 is a detailed end elevation view of the configuration illustrated in FIG. 5 in the expanded condition.

The adjustable mounting frame members may have square cut ends as illustrated in FIG. 6 but will preferably be mitre cut as illustrated in FIGS. 1 to 3.

The adjustable mounting frame members 14 are movable relative to the rigid surround frame 11 through the provision of one or more adjustment mechanisms.

According to a particularly preferred embodiment, two adjustment mechanisms are provided on any one adjustable mounting frame member 14. Each of the adjustment mechanisms is provided towards opposite ends of the adjustable mounting frame member which will allow an installer to move the ends of each adjustable mounting frame member independently of one another to adjust the separation distance of the adjustable mounting frame member relative to the rigid surround frame and/or the angle of the adjustable mounting frame member relative thereto. An approximate location is illustrated in FIG. 6. According to this configuration, a rectangular window will preferably have eight adjustment mechanisms, two provided on each side, relative to the adjustable mounting frame member on each side.

The preferred adjustment mechanism is simple and robust. A threaded mechanism is particularly preferred allowing an installer to rotate a threaded member in order to adjust the effective external dimension and/or shape of the adjustable mounting frame through adjustment of each of the adjustable mounting frame members. This means that an installer can adjust the adjustable mounting frame to the size of the opening and also adjust to account for out of square openings.

A particularly preferred mechanism illustrated in detail in FIGS. 5 to 8, includes a threaded rod 20 and a pair of internally threaded tubular portions 21. As illustrated, one tubular portion 21' is provided in the rigid surround frame member 12 and a corresponding tubular portion 21" is provided in the adjustable mounting frame member 14. Typically, the tubular portions 21', 21" are coaxial in order for the rod 20 to engage both.

The rod 20 will preferably be threaded over its entire length in order to give the maximum possible adjustability but opposite ends of the rod have opposite threads or threads extending in different directions, opposite one another. The tubular portions 21', 21" provided correspond to the threaded portions on the opposite ends of the rod 20. This configuration means that smaller rotations of the threaded rod 20 results in larger adjustments of the separation distance between the adjustable mounting frame member 14 and the rigid surround frame 12 meaning that an installer can save time in the adjustment process.

According to the preferred embodiment, the opposite threads on the rod 20 will preferably extend over approximately half of the length of the rod 20 each.

Preferably, the tubular portion 21' provided in the rigid surround frame member 12 is recessed within the thickness of the rigid surround frame member 12 as illustrated in FIG. 5. As illustrated in that Figure, the end of the threaded rod 20 is also be recessed below the surface of the rigid surround frame member 12 The threaded rod will typically be accessible through an opening 22 in a surface of the rigid surround frame member 12 as illustrated in FIG. 6 and this opening 22 may be temporarily covered by a cap or cover or similar.

As shown in FIG. 5, the accessible end of the threaded rod 20 has a shaped slot 23 for receiving a portion of a screwdriver used to rotate the threaded rod 20.

In use, the window, shutter or door assembly will be placed within the opening and the installer will then use the adjustment mechanisms around the window, shutter or door in order to drive the rods in the different adjustment mechanisms to expand the adjustable frame in order to fit the opening. Following the adjustment, the window, shutter or door assembly will normally be fixed permanently within the opening.

According to the embodiments illustrated in FIGS. 1 to 3, a cover member 24 is provided at the corners of the adjustable mounting frame in order to cover gaps created between the adjustable mounting frame members 14 caused by the expansion of the adjustable mounting frame. In a preferred embodiment, the corner cover members 24 are mounted relative to the adjustable mounting frame members 14, normally, clipping onto the adjustable mounting frame members 14, but allow the adjustable mounting frame members 14 to slide relative thereto.

Figure 9:
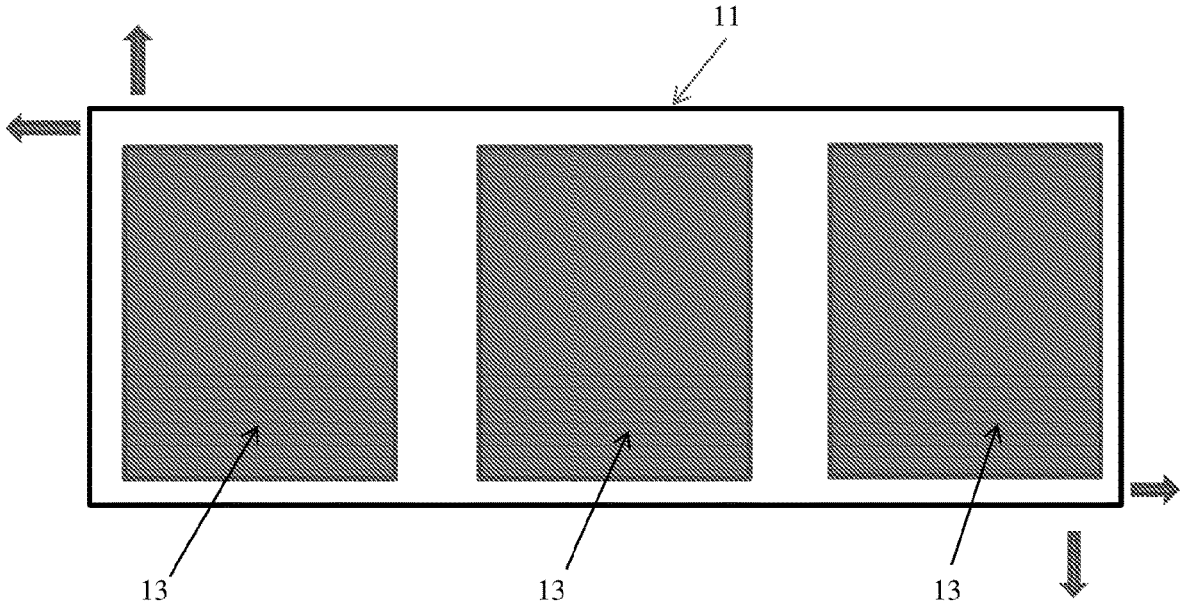
FIG. 9 is a schematic view of one possible embodiment of the present invention in which a number of infill panels are provided in a single rigid surround frame.
Figure 10:
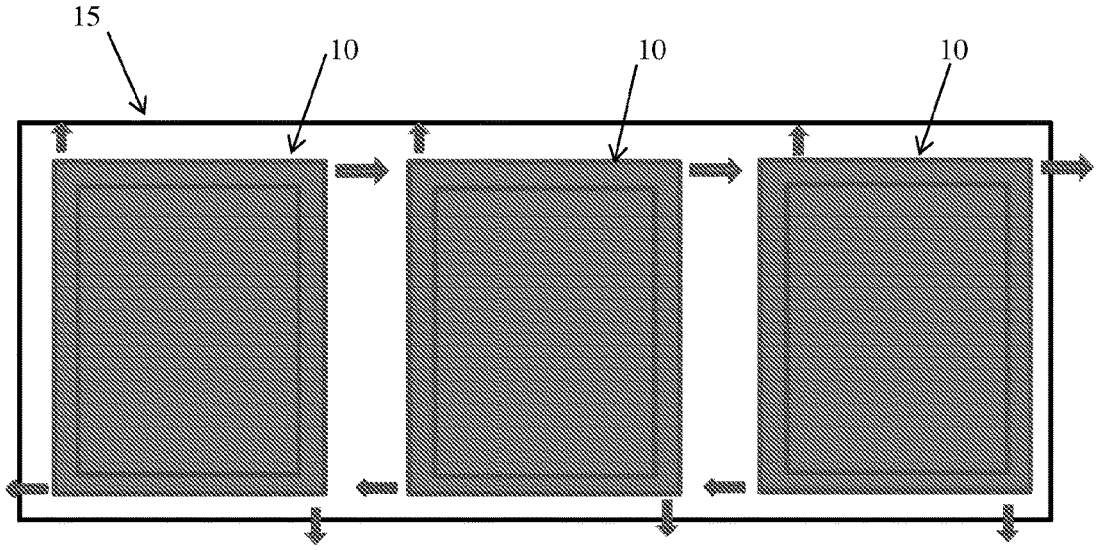
FIG. 10 is a schematic view of an alternative embodiment in which a number of individually adjustable window, shutter or door assemblies are provided in an opening.

As mentioned above, there may be more than one infill portions or an infill portion may be provided within the rigid surround frame which is made up of a number of window, shutter or door assemblies. Two alternative configurations are illustrated in FIGS. 9 and 10. In FIG. 9, one rigid surround frame 11 is provided with multiple infill panels 13 such that the entire assembly is adjustable as shown by the arrows. In FIG. 10, a plurality of window, shutter or door assemblies 10 are provided within a single opening with each of the window, shutter or door assemblies 10 being adjustable as shown by the arrows. One or more fixed separator members or assemblies can be provided between infill panels or window, shutter or door assemblies in a single opening.

It is important that the configuration inside the adjustable mounting frame is less important than the adjustable mounting frame itself and its relationship with the rigid surround frame and the mechanism of movement of the adjustable mounting frame relative thereto.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. An adjustable mounting frame for mounting a window, door or shutter into an opening, the window, door or shutter including a rigid surround frame with a number of peripheral sides, the adjustable mounting frame comprising:

at least one frame member relative to each peripheral side of the rigid surround frame of the window, door or shutter and movable relative thereto to abut part of a periphery of the opening to adjust the size of the adjustable mounting frame in one or more dimensions; and an adjustment mechanism for movement of the adjustable mounting frame members relative to the rigid surround frame;

wherein a cover member or assembly is provided between adjacent frame members of the adjustable mounting frame in order to cover any gaps created between the frame members caused by the expansion of the adjustable mounting frame, and the cover member or assembly is configured to allow the adjacent frame members to slide relative thereto; and wherein the adjustment mechanism includes a threaded rod and a pair of internally threaded tubular portions, one tubular portion provided in the rigid surround frame member and a corresponding tubular portion is provided in the adjustable mounting frame member, the tubular portions being coaxial in order for the threaded rod to engage both.

2. The adjustable mounting frame as claimed in claim 1 wherein the frame members are movable independently of one another in order to take up any inconsistency within the opening and to position and mount the window, door or shutter or other building construction, in the opening.

3. The adjustable mounting frame as claimed in claim 1 provided in a full reveal, semi-reveal or face fit configuration.

4. The adjustable mounting frame as claimed in claim 1 wherein more than one frame member is provided relative to each peripheral side of the rigid surround frame.

5. The adjustable mounting frame as claimed in claim 1 further including an adjustment mechanism for movement of the adjustable mounting frame members relative to the rigid surround frame.

6. The adjustable mounting frame as claimed in claim 1 wherein each of the at least one frame members is at least partially U-shaped with a pair of spaced apart walls between which the respective frame member of the rigid surround frame of the window, shutter or door is received and a transverse wall extending therebetween.

7. The adjustable mounting frame as claimed in claim 6 wherein the adjustment mechanism is provided between the spaced apart walls of the at least one frame member.

8. The adjustable mounting frame as claimed in claim 7 wherein the adjustment mechanism is provided relative to the transverse wall of the at least one frame member.

9. The adjustable mounting frame as claimed in claim 7 wherein two adjustment mechanisms are provided on any one adjustable mounting frame member.

10. The adjustable mounting frame as claimed in claim 9 wherein the adjustment mechanisms are provided towards opposite ends of each adjustable mounting frame member to allow an installer to move an end of each adjustable mounting frame member independently of one another to adjust the separation distance of the adjustable mounting frame member relative to the rigid surround frame and/or the angle of the adjustable mounting frame member relative thereto.

11. The adjustable mounting frame as claimed in claim 7 wherein the adjustment mechanism is a threaded mechanism allowing an installer to rotate a threaded member in order to adjust the effective external dimension and/or shape of the adjustable mounting frame through adjustment of each of the adjustable mounting frame members.

12. The adjustable mounting frame as claimed in claim 1 wherein opposite ends of the threaded rod have opposite threads or threads extending in different directions, opposite to one another.

13. The adjustable mounting frame as claimed in claim 12 wherein the opposite threads on the threaded rod extend over approximately half of the length of the threaded rod each.

14. The adjustable mounting frame as claimed in claim 1 wherein a first tubular portion is provided in a transverse wall of the at least one frame member and a second tubular portion is provided in the rigid surround frame, the tubular portions recessed within the thickness of the respective member.

15. The adjustable mounting frame as claimed in claim 14 wherein permanent fixtures are provided through the transverse wall of each adjustable mounting frame member once the mounting frame member has been properly fitted into the opening.

16. The adjustable mounting frame as claimed in claim 1 wherein the threaded rod is accessible through an opening provided in a surface of the rigid surround frame member.

17. The adjustable mounting frame as claimed in claim 1 wherein the cover members are corner members mounted relative to the adjustable mounting frame members.

18. The adjustable mounting frame as claimed in claim 17 wherein the cover members are clipped onto the adjustable mounting frame members.

19. The adjustable mounting frame as claimed in claim 1 wherein the at least one frame member abuts the periphery of the opening into which the window, shutter or door is fixed and some expansion of the adjustable mounting frame is required in order to achieve this.

20. The adjustable mounting frame as claimed in claim 19 wherein one or more fixtures is used in order to permanently fix the adjustable mounting frame members in place and thereby fix the window, shutter or door in place, these fixtures provided through the adjustable mounting frame members once the adjustable mounting frame has been fitted in place and expanded.

21. A window, door or shutter assembly including a window, door or shutter including a rigid surround frame with a number of peripheral sides and an adjustable mounting frame comprising:

at least one frame member relative to each peripheral side of the rigid surround frame of the window, door or shutter and movable relative thereto to abut part of a periphery of an opening into which the window, door or shutter assembly is to be fitted to adjust the size of the adjustable mounting frame in one or more dimensions to fit the opening; and an adjustment mechanism for movement of the adjustable mounting frame members relative to the rigid surround frame;

wherein a cover member or assembly is provided between adjacent frame members of the adjustable mounting frame in order to cover any gaps created between the frame members caused by the expansion of the adjustable mounting frame, and the cover member or assembly is configured to allow the adjacent frame members to slide relative thereto; and wherein the adjustment mechanism includes a threaded rod and a pair of internally threaded tubular portions, one tubular portion provided in the rigid surround frame member and a corresponding tubular portion is provided in the adjustable mounting frame member, the tubular portions being coaxial in order for the threaded rod to engage both.

* * * * *